US007712519B2

(12) United States Patent
McElhinney et al.

(10) Patent No.: US 7,712,519 B2
(45) Date of Patent: May 11, 2010

(54) TRANSVERSE MAGNETIZATION OF CASING STRING TUBULARS

(75) Inventors: Graham McElhinney, Inverurie (GB); Leon Ceh, Calgary (CA)

(73) Assignee: Smith International, Inc., Houston, TX (US)

( * ) Notice: Subject to any disclaimer, the term of this patent is extended or adjusted under 35 U.S.C. 154(b) by 894 days.

(21) Appl. No.: 10/536,124

(22) Filed: Aug. 25, 2006

(65) Prior Publication Data

US 2009/0173504 A1 Jul. 9, 2009

(51) Int. Cl.
*E21B 17/00* (2006.01)
*E21B 17/08* (2006.01)

(52) U.S. Cl. ..... 166/66.5; 166/380; 335/284

(58) Field of Classification Search ..... 166/66.5, 166/243, 255.2, 284, 380, 381; 335/284
See application file for complete search history.

(56) References Cited

U.S. PATENT DOCUMENTS

| | | | | |
|---|---|---|---|---|
| 3,452,343 | A * | 6/1969 | Crank et al. | 360/89 |
| 3,725,777 | A | 4/1973 | Robinson et al. | |
| 4,072,200 | A | 2/1978 | Morris et al. | |
| 4,458,767 | A | 7/1984 | Hoehn, Jr. | |
| 4,465,140 | A | 8/1984 | Hoehn, Jr. | |
| 5,485,089 | A | 1/1996 | Kuckes | |
| 5,512,830 | A | 4/1996 | Kuckes | |
| 5,541,517 | A | 7/1996 | Hartmann et al. | |
| 5,589,775 | A | 12/1996 | Kuckes | |
| 5,657,826 | A | 8/1997 | Kuckes | |
| 5,675,488 | A | 10/1997 | McElhinney | |
| 5,923,170 | A | 7/1999 | Kuckes | |
| 6,369,679 | B1 | 4/2002 | Cloutier et al. | |
| 6,698,516 | B2 | 3/2004 | Van Steenwyk et al. | |
| 6,853,280 | B2 * | 2/2005 | Sugawara et al. | 335/284 |
| 6,991,045 | B2 | 1/2006 | Vinegar et al. | |
| 2006/0131013 | A1 | 6/2006 | McElhinney | |

FOREIGN PATENT DOCUMENTS

| | | |
|---|---|---|
| CA | 2490953 | 6/2006 |
| EP | 0 301 671 B1 | 2/1989 |
| GB | 2 376 747 A | 8/2002 |
| WO | WO95/19490 | 7/1995 |

OTHER PUBLICATIONS

A. G. Nekut, A. F. Kuckes, and R. G. Pitzer, "Rotating Magnet Ranging—a new drilling guidance technology," 8th One Day Conference on Horizontal Well Technology, Canadian Se.

(Continued)

*Primary Examiner*—Daniel P Stephenson

(57) ABSTRACT

A method and apparatus for imparting a transverse magnetization to a wellbore tubular is disclosed. In certain exemplary embodiments, tubulars are magnetized to include at least one flux reversal (e.g., at the center of the tubular) at which the direction of the transverse field changes (i.e., from pointing radially inward to pointing radially outward). A plurality of such magnetized wellbore tubulars may be coupled together and lowered into a target well to form a magnetized section of a casing string. Exemplary embodiments of the invention may be utilized to impart a strong, highly uniform magnetic field about a string of wellbore tubulars, thereby providing for improved passive ranging and wellbore twinning.

15 Claims, 5 Drawing Sheets

OTHER PUBLICATIONS

W-D Coils brochure by Western Instruments, published Mar. 2001:http://www.westerninstruments.com/portableMPI/coils/WD_COI_1.jpg, http://www.westerninstruments.com/portableMP.

J.I. de Lange and T.J. Darling, "Improved detectability of blowing wells," SPE Drilling Engineering, Mar. 1990.

T.L. Grills, "Magnetic ranging technologies for drilling steam assisted gravity drainage well pairs and unique well geometries—A comparison of Technologies," SPE/Petroleum Society of CIM/CHOA 79005, 2002.

* cited by examiner

TRANSVERSE MAGNETIZATION OF CASING STRING TUBULARS

RELATED APPLICATIONS

None.

FIELD OF THE INVENTION

The present invention relates generally to drilling and surveying subterranean boreholes such as for use in oil and natural gas exploration. In particular, this invention relates to an apparatus and a method for imparting a transverse magnetization to wellbore tubulars to enhance the magnetic field about a target borehole.

BACKGROUND OF THE INVENTION

The use of magnetic field measurements in prior art subterranean surveying techniques for determining the direction of the earth's magnetic field at a particular point is well known. Techniques are also well known for using magnetic field measurements to locate subterranean magnetic structures, such as a nearby cased borehole. These techniques are often used, for example, in well twinning applications in which one well (the twin well) is drilled in close proximity and often substantially parallel to another well (commonly referred to as a target well).

The magnetic techniques used to sense a target well may generally be divided into two main groups; (i) active ranging and (ii) passive ranging. In active ranging, the local subterranean environment is provided with an external magnetic field, for example, via a strong electromagnetic source in the target well. The properties of the external field are assumed to vary in a known manner with distance and direction from the source and thus in some applications may be used to determine the location of the target well. In contrast to active ranging, passive ranging techniques utilize a preexisting magnetic field emanating from magnetized components within the target borehole. In particular, conventional passive ranging techniques generally take advantage of remanent magnetization in the target well casing string. Such remanent magnetization is typically residual in the casing string because of magnetic particle inspection techniques that are commonly utilized to inspect the threaded ends of individual casing tubulars.

In co-pending U.S. patent application Ser. No. 11/301,762 to McElhinney, a technique is disclosed in which a predetermined magnetic pattern is deliberately imparted to a plurality of casing tubulars. These tubulars, thus magnetized, are coupled together and lowered into a target well to form a magnetized section of casing string typically including a plurality of longitudinally spaced pairs of opposing magnetic poles. Passive ranging measurements of the magnetic field may then be advantageously utilized to survey and guide drilling of a twin well relative to the target well. This well twinning technique may be used, for example, in steam assisted gravity drainage (SAGD) applications in which horizontal twin wells are drilled to recover heavy oil from tar sands.

McElhinney discloses the use of, for example, a single magnetizing coil to impart the predetermined magnetic pattern to each of the casing tubulars. As shown on FIG. 1A, a hand-held magnetizing coil 80 having a central opening (not shown) is deployed about exemplary tubular 60. A DC current is passed through the windings in the coil 80 (the current traveling circumferentially about the tubular), which imparts a substantially permanent, strong, longitudinal magnetization to the tubular 60 in the vicinity of the coil 80. After some period of time (e.g., 5 to 15 seconds) the current is interrupted and the coil 80 moved longitudinally to another portion of the tubular 60 where the process is repeated, thereby longitudinally magnetizing another region of the tubular 60. To impart a pair of opposing magnetic poles 65 (FIG. 1B), McElhinney discloses reversing the direction of the current about coil 80 or alternatively redeploying the coil 80 about the tubular 60 such that the electric current flows in the opposite circumferential direction, thereby imparting a longitudinal magnetization having the opposite polarity.

FIG. 1B depicts an exemplary tubular 60 magnetized as described above with respect to FIG. 1A. As shown, tubular 60 includes a plurality of discrete magnetized zones 62 (typically three or more). Each magnetized zone 62 may be thought of as a discrete cylindrical magnet having a north N pole on one longitudinal end thereof and a south S pole on an opposing longitudinal end thereof such that a longitudinal magnetic flux 68 is imparted to the tubular 60. Tubular 60 further includes a single pair of opposing north-north NN poles 65 at the midpoint thereof. The purpose of the opposing magnetic poles 65 is to focus magnetic flux outward from tubular 60 as shown at 70 (or inward for opposing south-south poles as shown at 72).

While the above described method of magnetizing wellbore tubulars has been successfully utilized in well twinning applications, there is room for yet further improvement. For example, it has been found that the above described longitudinal magnetization method can result in a somewhat non-uniform magnetic flux density along the length of a casing string at distances of less than about 6-7 meters. If unaccounted, the non-uniform flux density can result in distance errors on the order of about ±10 percent during well twinning operations. While such distance errors are typically within specification for most well twinning operations, it would be desirable to improve the accuracy of distance calculations between the target and twin wells.

Therefore, there exists a need for an improved apparatus and method for magnetizing wellbore tubulars. In particular, a method of magnetization that results in improved magnetic flux uniformity along the length of a string of magnetized tubulars would be advantageous.

SUMMARY OF THE INVENTION

Exemplary aspects of the present invention are intended to address the above described need for an improved apparatus and method for magnetizing casing tubulars. One aspect of this invention includes a method for magnetizing a wellbore tubular so that at least a portion of the wellbore tubular includes a transverse magnetization. As used herein, the term transverse magnetization refers to a magnetization in which the magnetic field is aligned substantially cross axially (or radially) in the wall of the tubular. A tubular having a transverse magnetization in accordance with this invention includes a magnetic pole (N or S) on an inner surface thereof and an opposite magnetic pole (S or N) on a radially opposed outer surface thereof. In advantageous embodiments, tubulars are magnetized to include at least one flux reversal (e.g., at the center of the tubular) at which the direction of the transverse field changes (i.e., from pointing radially inward to pointing radially outward). A plurality of such magnetized wellbore tubulars may be coupled together and lowered into the target well to form a magnetized section of a casing string.

Exemplary embodiments of the present invention may be advantageously utilized to impart a strong, highly uniform magnetic field about a string of wellbore tubulars. Measurements of the magnetic field strength in proximity to a magnetized target casing string are thus typically suitable to determine distance to the target well and may be advantageously utilized to drill a twin well along a predetermined course relative to the target well. The uniform magnetic field tends to provide for accurate distance determination during passive ranging, and therefore accurate well placement during twinning operations, such as in SAGD drilling operations.

In one aspect, the present invention includes a method for creating a magnetic profile about a string of wellbore tubulars. The method includes magnetizing a wellbore tubular at a plurality of locations along a length thereof, the magnetization imparting a magnetic pole to an inner surface of the tubular and an opposing magnetic pole to a radially opposed outer surface of the tubular. The method further includes repeating the above magnetization for a plurality of tubulars and coupling the magnetized tubulars to one another.

In another aspect, this invention includes a magnetized wellbore tubular. The tubular includes a predetermined magnetic pattern intentionally imparted thereto, the magnetic pattern including at least one region in which an inner surface of the tubular includes a magnetic pole and a radially opposed outer surface of the tubular includes an opposite magnetic pole.

In still another aspect, this invention includes an apparatus for imparting a transverse magnetization to a wellbore tubular. The apparatus includes a magnetizing ring and a magnetizing cylinder deployed coaxially in the magnetizing ring, the magnetizing ring and the magnetizing cylinder disposed to receive a wellbore tubular such that the magnetizing ring is concentric about the tubular and the magnetizing cylinder is concentric in the cylinder. A length of magnetically permeable material is magnetically connected to both the magnetizing ring and the magnetizing cylinder, and a winding is deployed about at least a portion of the length.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1A:
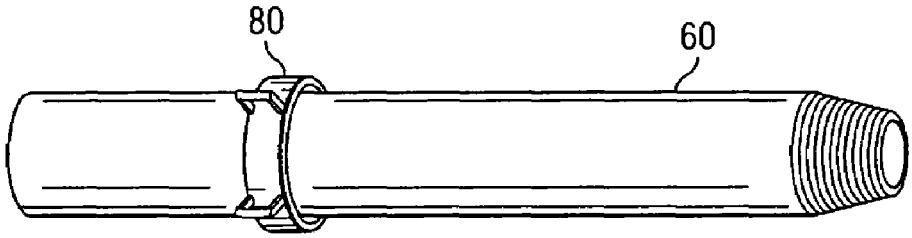
FIG. 1A (PRIOR ART)
FIG. 1A depicts a prior art arrangement for magnetizing a casing tubular.
Figure 1B:
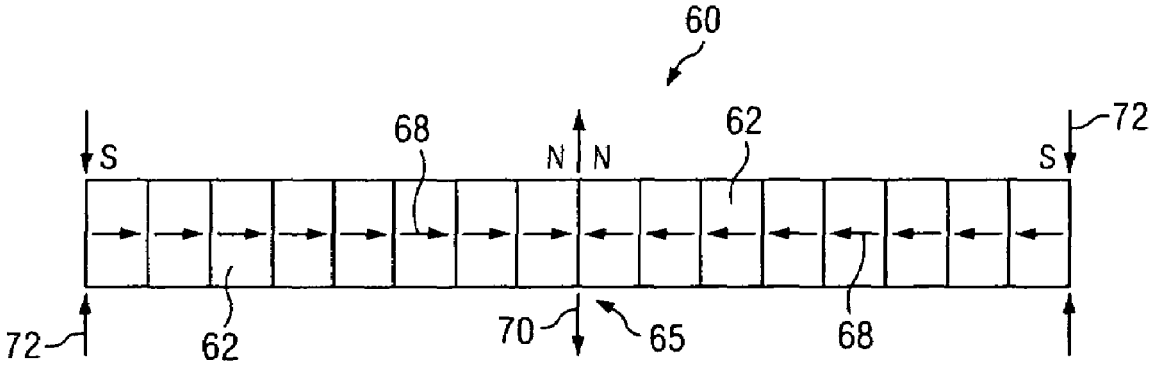
FIG. 1B (PRIOR ART)
FIG. 1B depicts a wellbore tubular magnetized with the prior art arrangement shown on FIG. 1A.

With reference to FIGS. 2 through 4C, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 2 through 4C may be described herein with respect to that reference numeral shown on other views.

Figure 2:
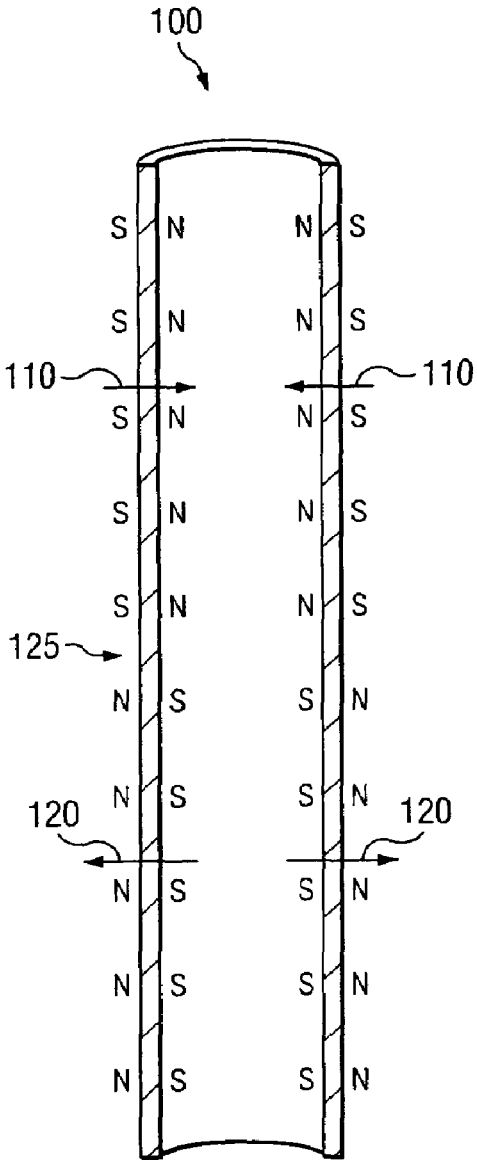
FIG. 2 depicts a wellbore tubular magnetized in accordance with the present invention.

Referring now to FIG. 2, one exemplary embodiment of a casing tubular 100 magnetized in accordance with the present invention is shown. Tubular 100 is magnetized such that it includes at least one region having a transverse magnetization. As used herein, the term transverse magnetization refers to a magnetization in which the magnetic field is aligned substantially cross axially (or radially) through the wall of the tubular 100. In the exemplary embodiment shown, tubular 100 includes 10 discrete magnetized zones each of which includes a magnetic pole (N or S) on an inner surface thereof and an opposite magnetic pole (S or N) on a radially opposed outer surface thereof. Such a transverse magnetization results in a magnetic flux that is directed radially inwards 110 towards the longitudinal axis of the tubular 100 or radially outwards 120 away from the longitudinal axis. It will be appreciated that the invention is not limited to discrete magnetized zones. Tubular 100 may alternatively include a continuous magnetization in which the inner surface thereof includes one magnetic pole (N or S) and the outer surface thereof includes the opposite magnetic pole (S or N).

With continued reference to FIG. 2, exemplary embodiments of tubular 100 may optionally also include at least one magnetic flux reversal 125 at which the direction of the transverse magnetic field changes (i.e., from pointing radially inward as shown at 110 to pointing radially outward as shown at 120). In the exemplary embodiment shown, tubular 100 includes a single reversal 125 located at the approximate center of the tubular 100. Other embodiments may include two or more flux reversals 125 located at substantially any longitudinal positions along the tubular 100. The invention is not limited in regard to the number or location of the reversals.

Figure 3:
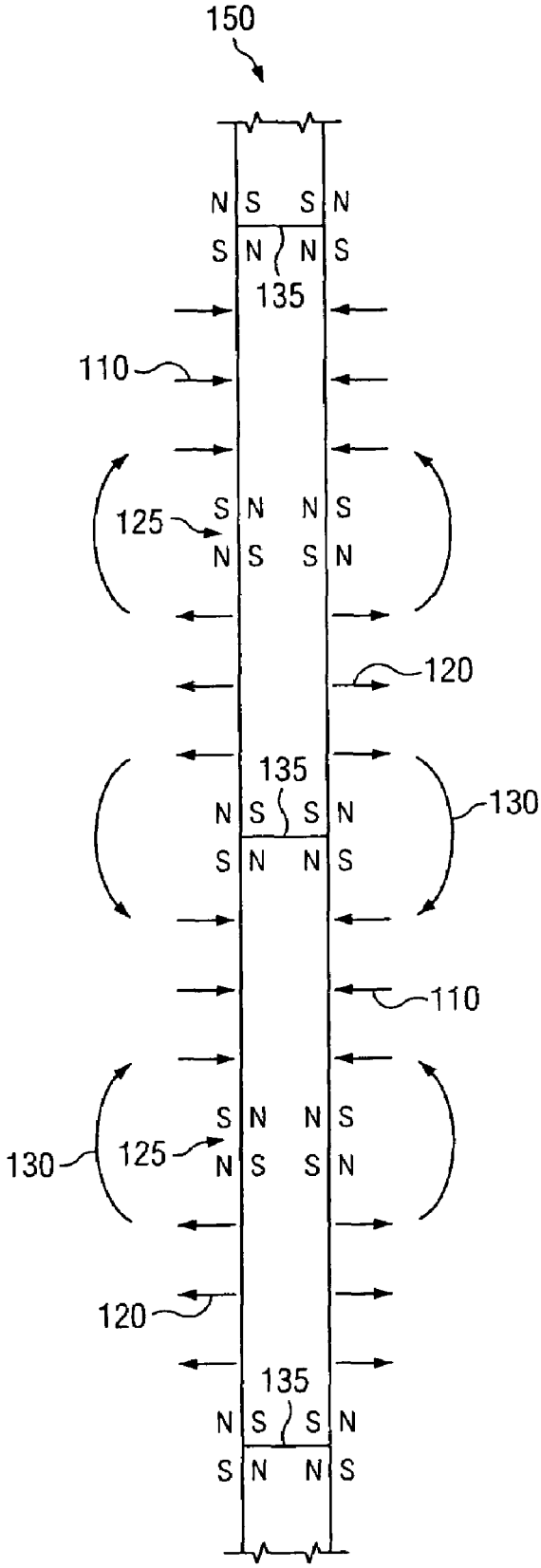
FIG. 3 depicts a casing string including a plurality of wellbore tubulars magnetized in accordance with the present invention.

Turning now to FIG. 3, one exemplary embodiment of a casing string 150 is shown, the casing string 150 including a plurality of premagnetized tubulars 100 threaded end to end. In the exemplary embodiment shown, casing string 150 includes about twice as many magnetic flux reversals 125 as tubulars 100 (one at the approximate center of each tubular 100 and one at each joint 135 between adjacent tubulars 100). Thus, the flux reversals 125 are spaced at intervals of about one-half the length of the tubular 100 (e.g., at about 7 meter intervals for a casing string made up of 14 meter tubulars). Advantageous casing string embodiments include a plurality of magnetic flux reversals 125 with the longitudinal spacing between adjacent reversals 125 being less than or equal to the length of a single tubular 100, although the invention is not limited in this regard.

Magnetic flux reversals 125 may also be imparted to the joints 135 of a casing string without imparting a flux reversal along the length of any particular tubular. For example, a casing string may be made up of tubulars having opposite transverse magnetizations (those with a magnetic flux directed radially inward and those with a magnetic flux directed radially outward). Magnetic flux reversals can be formed at the joints 135 by alternating the tubulars in the casing string. For example, a casting string in which odd tubulars have a flux directed radially inward and even tubulars have flux directed radially outward would include a flux reversal at each joint between the tubulars. Likewise, two by two deployments (two inwardly magnetized tubulars followed by two outwardly magnetized tubulars and so on) result in a casing string in which every other joint includes a magnetic flux reversal. The artisan or ordinary skill will readily recognize that substantially any spacing of the flux reversals may be achieved in this manner.

It will be appreciated that the preferred spacing between magnetic flux reversals 125 depends on many factors, such as the desired distance between the twin and target wells, and that there are tradeoffs in utilizing a particular spacing. In general, the magnetic field strength about a casing string (or section thereof) becomes more uniform along the longitudinal axis of the casing string with reduced spacing between the flux reversals 125 (i.e., increasing the ratio of flux reversals 125 to tubulars 100). However, the fall off rate of the magnetic field strength as a function of radial distance from the casing string tends to increase as the spacing between the flux reversals decreases. Thus, it may be advantageous to use a casing string having more closely spaced flux reversals 125 for applications in which the distance between the twin and target wells is relatively small and to use a casing string having a greater distance between flux reversals 125 for applications in which the distance between the twin and target wells is larger. Moreover, for some applications it may be desirable to utilize a casing string having a plurality of magnetized sections, for example a first section having a relatively small spacing between flux reversals 125 and a second section having a relatively larger spacing between flux reversals 125.

Finite element modeling of the casing 150 has shown the magnetic field strength to be advantageously highly uniform along the length of the casing 150 at radial distances greater than a few meters. The uniform magnetic field strength is the result of the transverse magnetic pattern imparted to the tubulars 100. As shown schematically on FIG. 3, magnetic flux is directed radially inward 110 towards or radially outward 120 away from the longitudinal axis of tubular 100 in regions of the casing string 150 between the flux reversals 125. The magnetic flux density in these regions is advantageously approximately constant along the length of the tubular 100 (even at the surface of the tubular). It will be understood to those of skill in the art that the magnetic flux into 110 and out of 120 the tubular 100 loops around the reversals 125 as shown at 130 (i.e., exiting the casing string 150 on one side of a reversal 125 as shown at 120 and entering the casing string 150 on a longitudinally opposed side of the reversal 125 as shown at 110).

The resulting magnetic field strength is approximately constant (uniform) along the length of the casing string at any particular radial distance (e.g., within a few percent at radial distances greater than a few meters). Moreover, the magnetic field strength decreases with increasing radial distance (with magnetic contour lines essentially paralleling the casing string at radial distances greater than a few meters). It will be appreciated that during exemplary twinning applications of such a target well, the radial distance to the target well may be advantageously determined and controlled based simply on magnetic field strength measurements. The direction to the target well may be advantageously controlled based on measurements of the direction of the magnetic field in the plane of the tool face as disclosed in commonly assigned U.S. Pat. No. 6,985,814 and U.S. Patent Publication 2006/0131013.

It will be appreciated that the terms magnetic flux density and magnetic field are used interchangeably herein with the understanding that they are substantially proportional to one another and that the measurement of either may be converted to the other by known mathematical calculations.

Figure 4A:
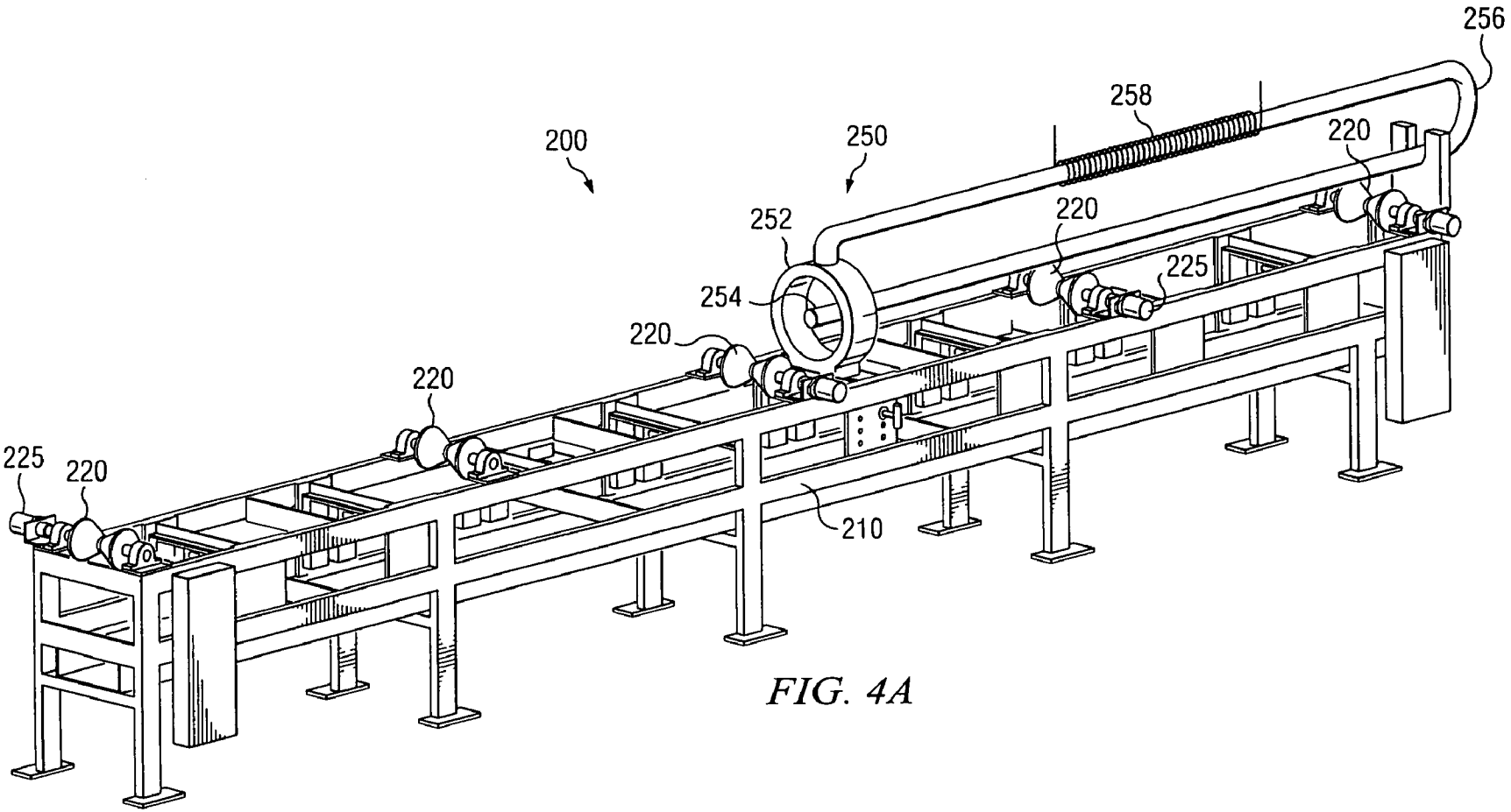
FIG. 4A depicts an exemplary apparatus for imparting a transverse magnetization in accordance with this invention.
Figure 4B:
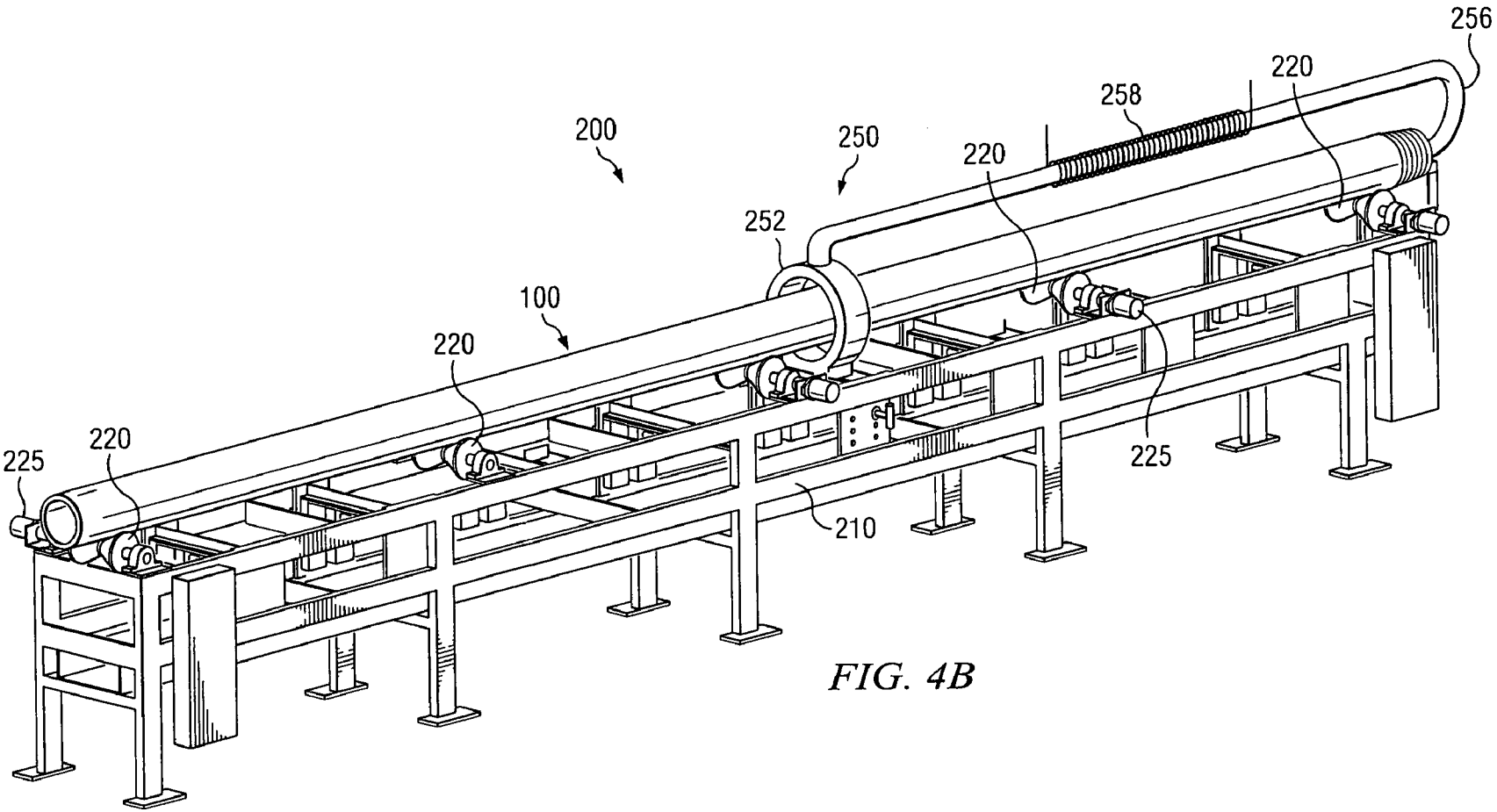
FIG. 4B depicts the apparatus of FIG. 4A having a wellbore tubular deployed therein.
Figure 4C:
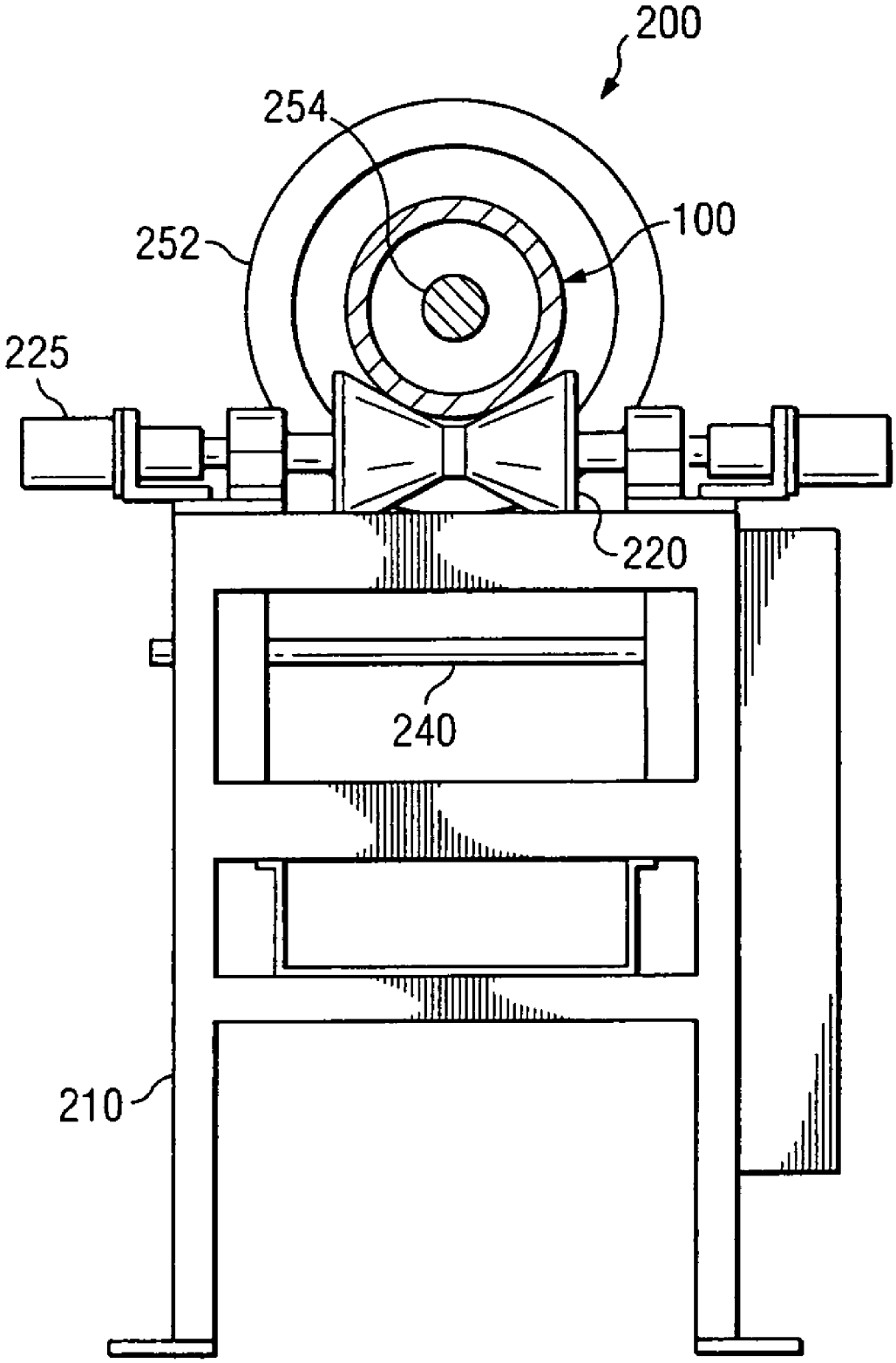
FIG. 4C depicts a side view of the apparatus of FIG. 4B including the wellbore tubular deployed therein.

Referring now to FIGS. 4A through 4C, one exemplary embodiment of an apparatus 200 for imparting a transverse magnetic field to a wellbore tubular is shown. In FIG. 4B, apparatus 200 is shown with an exemplary tubular 100 deployed thereon. Otherwise FIGS. 4A and 4B are identical. In the exemplary embodiment shown, apparatus 200 includes a plurality of rollers 220 deployed on a nonmagnetic (e.g., aluminum) frame 210. The plurality of rollers may be thought of as a track along which tubulars 100 may be moved in a direction substantially parallel with their longitudinal axis. As such, the portion of the rollers 220 in contact with the tubular 100 is typically fabricated from a non magnetic material such as nylon or a urethane rubber. Exemplary embodiments of apparatus 200 may further include one or more motors 225 (e.g., electric or hydraulic motors) deployed on the frame 210 and disposed to drive selected ones (or all) of the rollers 220. In such exemplary embodiments, the tubulars 100 may be advantageously driven along the track thereby reducing tubular handling requirements and enabling the tubulars 100 to be accurately and repeatably positioned along the track. Apparatus 200 may also optionally include one or more positioning sensors (e.g., infrared sensors) disposed to detect the relative position of a tubular 100 along the track. The use of such sensors, in combination with computerized control of motors 125, advantageously enables automatic positioning of the tubulars 100 on the track.

With continued reference to FIGS. 4A through 4C, apparatus 200 further includes a magnetizing module 250 deployed on the frame 210. In the exemplary embodiment shown, the magnetizing module 250 includes a magnetizing ring 252 deployed concentrically about a magnetizing cylinder 254. The ring 252 and cylinder 254 are disposed to receive tubular 100 (FIGS. 4B and 4C) such that the cylinder 254 is concentric in the tubular 100 and the ring 252 is concentric about the tubular 100. The ring 252 and cylinder 254 are magnetically connected via a length of magnetically permeable material 256 having a winding 258 wrapped around at least a portion of the length. In the exemplary embodiment shown, the length of magnetically permeable material 256 is at least half the length of the tubular 100 so that the tubular may be magnetized along its entire length if desired. However, the invention is not limited in this regard.

In use, one end of a tubular 100 is rolled longitudinally into magnetizing module 250 (i.e., through ring 252 and about the cylinder 254 and a portion of the magnetically permeable material 256 as shown on FIG. 4B). An electrical current (typically DC) in the winding 258 induces opposite magnetic poles on the ring 252 and cylinder 254 (e.g., a magnetic north pole on the ring 252 and a magnetic south pole on the cylinder 254). This in turn imparts opposite magnetic poles to the inner and outer surfaces of the tubular in the vicinity of the ring 252 and cylinder 254 (e.g., a magnetic north pole on the outer surface and a magnetic south pole on the inner surface). Reversing the current in the winding 258 reverses the magnetic poles on the ring 252 and cylinder 254 and thereby also reverses the magnetic poles imparted to the tubular 100. A continuous magnetic field pattern may be imparted along the length of the tubular 100, for example, by maintaining an electrical current in the winding 258 while the tubular is traversed longitudinally through the ring 252. A discrete magnetic pattern may be imparted by turning the electrical current on while the tubular 100 is stationary at one or more predetermined positions along the track.

With continued reference to FIGS. 4A through 4C, a magnetic flux reversal 125 may be imparted, for example, by (i) deploying the tubular 100 at a first predetermined longitudinal position in the ring 252, (ii) applying an electrical current to the winding 258, (iii) traversing the tubular to a second predetermined longitudinal position, and (iv) applying an electric current of the opposite polarity to the winding 258. As described above with respect to FIG. 3, the preferred spacing of magnetic flux reversals along a casing string depends on many factors, such as the desired distance between the twin and target wells. As also described above, there are tradeoffs in utilizing a particular spacing. Apparatus 200 advantageously enables a wide range of transverse magnetic patterns (e.g., substantially any number of magnetic flux reversals having substantially any spacing) to be imparted to the tubulars 100.

It is well known to those of ordinary skill in the art that there are many standard tubular diameters. Moreover, it is not uncommon for a single well to utilize more than one casing diameter. For example, many wells have a relatively large diameter near the surface (e.g., 9 to 12 inch) and a relatively small diameter (e.g., 6 to 9 inch) near the bottom of the well. In order to accommodate a range of tubular diameters, the magnetizing module 250 may be disposed to move vertically with respect to the frame 210. Such vertical movement enables the tubular 100 to be deployed concentrically with the ring 252 and cylinder 254. The magnetizing module 250 may be Moved upward, for example, to accommodate larger diameter tubulars and downward to accommodate smaller diameter tubulars. In the exemplary embodiment shown, the magnetizing module 250 may be manually moved into one of a plurality (e.g., three) of predetermined vertical positions and held in place by one or more pins 240. The invention is, of course, not limited in this regard. In an alternative embodiment, module 250 may be moved automatically, for example via computer-controlled stepper motors. Moreover, in another alternative embodiment the rollers 220 may be disposed to move vertically (rather than module 250). In such an alternative embodiment, the rollers 220 would be moved downwards to accommodate larger diameter tubulars and upwards to accommodate smaller diameter tubulars.

While not shown on FIGS. 4A through 4C, it will be appreciated that various aspects of apparatus 200 may be automated or semi-automated via computer control. For example, apparatus 200 may optionally include a computer controller (not shown) in electronic communication with motors 225 and magnetizing module 250 (e.g., winding 258). In such an exemplary embodiment, wellbore tubulars may be substantially automatically (i) longitudinally positioned in the magnetizing module 250, (ii) magnetized, (iii) repositioned and magnetized substantially any suitable number of times, and (iv) removed from the apparatus 200.

It will be appreciated that the invention is not limited to imparting a purely transverse magnetization. Wellbore tubulars magnetized in accordance with this invention may include both transverse and longitudinal magnetic fields as well as magnetic fields having both transverse and longitudinal components (i.e., a magnetic field that is angled with respect to both the transverse and longitudinal directions). The artisan of ordinary skill will readily recognize that an apparatus similar to apparatus 200 may be utilized to impart a magnetization having both transverse and longitudinal components. This may be accomplished, for example, by longitudinally offsetting ring 252 and cylinder 254 so that the magnetic pole imparted to the outer surface of the tubular is longitudinally offset from the magnetic pole imparted to the inner surface of the tubular.

Although the present invention and its advantages have been described in detail, it should be understood that various changes, substitutions and alternations can be made herein without departing from the spirit and scope of the invention as defined by the appended claims.

We claim:

1. A method for creating a magnetic profile about a string of wellbore tubulars, the method comprising:

(a) magnetizing a wellbore tubular at a plurality of locations along a length of the tubular, said magnetization imparting a magnetic pole to an inner surface of the tubular and an opposite magnetic pole to a radially opposed outer surface of the tubular;

(b) repeating (a) for a plurality of tubulars; and (c) coupling said magnetized tubulars to one another.

2. The method of claim 1, wherein (a) further comprises imparting a plurality of discrete magnetized zones to the tubular, each of the magnetized zones including a magnetic pole on an inner surface of the tubular and an opposite magnetic pole on a radially opposed outer surface of the tubular.

3. The method of claim 1, wherein (a) further comprises imparting at least one magnetic flux reversal to the tubular.

4. The method of claim 1, wherein coupling said magnetized tubulars in (c) results in a magnetic flux reversal at one or more joints between the tubulars.

5. The method of claim 1, wherein (a) comprises:

(i) deploying a magnetizing ring coaxially about the tubular and a corresponding magnetizing cylinder coaxially in the tubular, the ring and the cylinder magnetic connected via a length of magnetically permeable material;

(ii) energizing the ring and the cylinder such that ring includes a magnetic pole of one polarity and the cylinder includes a magnetic pole of the opposite polarity.

6. The method of claim 5, wherein the ring and the cylinder are deployed at substantially the same longitudinal position along the length of the cylinder.

7. A wellbore tubular comprising a predetermined magnetic pattern intentionally imparted thereto, the magnetic pattern including at least one region in which an inner surface of the tubular includes a magnetic pole and a radially opposed outer surface of the tubular includes an opposite magnetic pole.

8. The wellbore tubular of claim 7, wherein the wellbore tubular comprises a plurality of discrete magnetized zones, each of the magnetized zones including a magnetic pole on an inner surface of the tubular and an opposite magnetic pole on a radially opposed outer surface of the tubular.

9. The wellbore tubular of claim 8, wherein at least one pair of adjacent magnetized zones comprise oppositely directed magnetic fields.

10. The wellbore tubular of claim 7, comprising at least one magnetic flux reversal.

11. The wellbore tubular of claim 7, comprising a casing string tubular.

12. A string of wellbore tubulars comprising a plurality of wellbore tubulars threaded end to end, each of the wellbore tubulars including a predetermined magnetic pattern intentionally imparted thereto, the magnetic pattern including at least one region in which an inner surface of the tubular includes a magnetic pole and a radially opposed outer surface of the tubular includes an opposite magnetic pole.

13. The swing of tubulars of claim 12, wherein each of the wellbore tubulars comprises a magnetic flux reversal located along a length thereof.

14. The string of tubulars of claim 12, further comprising a magnetic flux reversal at a plurality of joints between the wellbore tubulars.

15. The string of tubulars of claim 12, wherein each of the joints between wellbore tubulars comprises a magnetic flux reversal.

* * * * *